US008365819B2

(12) United States Patent
Murphy et al.

(10) Patent No.: US 8,365,819 B2
(45) **Date of Patent: *Feb. 5, 2013**

(54) METHOD OF REDISTRIBUTING WELL BORE FLUID

(75) Inventors: Raymond P. Murphy, Litchfield Park, AZ (US); Timothy G. Barritt, Upton, WY (US); Richard G. Stockdale, Cheyenne, WY (US)

(73) Assignee: Big Cat Energy Corporation, Upton, WY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/927,621

(22) Filed: Nov. 19, 2010

(65) Prior Publication Data

US 2011/0067874 A1 Mar. 24, 2011

Related U.S. Application Data

(62) Division of application No. 11/910,895, filed as application No. PCT/US2006/012789 on Apr. 5, 2006, now abandoned.

(60) Provisional application No. 60/668,896, filed on Apr. 5, 2005.

(51) Int. Cl.
*E21B 33/12* (2006.01)

(52) U.S. Cl. ..... 166/186; 166/316; 166/305.1; 166/54.1

(58) Field of Classification Search ..... 166/380, 166/54.1, 105, 266, 68.5, 106, 369, 256, 166/65.1, 313
See application file for complete search history.

(56) References Cited

U.S. PATENT DOCUMENTS

| | | | | |
|---|---|---|---|---|
| 3,170,520 | A | 2/1965 | Arutunoff | |
| 3,363,692 | A * | 1/1968 | Bishop | 166/306 |
| 3,399,623 | A | 9/1968 | Creed | |
| 4,429,740 | A | 2/1984 | Malinchak | |
| 5,816,326 | A | 10/1998 | Slater | |
| 5,913,363 | A | 6/1999 | Paplinski | |
| 5,979,559 | A | 11/1999 | Kennedy | |
| 6,123,149 | A * | 9/2000 | McKinzie et al. | 166/266 |
| 6,325,143 | B1 | 12/2001 | Scarsdale | |
| 6,457,540 | B2 | 10/2002 | Gardes | |
| 6,745,855 | B2 | 6/2004 | Gardes | |
| 6,923,275 | B2 | 8/2005 | Gardes | |
| 7,216,720 | B2 | 5/2007 | Zimmerman | |
| 7,487,838 | B2 | 2/2009 | Knight et al. | |
| 2003/0062161 | A1 | 4/2003 | Mondelli et al. | |
| 2003/0221836 | A1 | 12/2003 | Gardes | |
| 2005/0252689 | A1 | 11/2005 | Gardes | |

FOREIGN PATENT DOCUMENTS

| | | | |
|---|---|---|---|
| CA | 2196959 | A1 | 8/1998 |
| WO | 03/102368 | A1 | 12/2003 |
| WO | 2006/108091 | A3 | 10/2006 |

OTHER PUBLICATIONS

U.S. Appl. No. 60/668,896, filed Apr. 5, 2005.
International Patent Cooperation Treaty Application No. PCT/US2006/012789, filed Apr. 5, 2006.
U.S. Appl. No. 11/910,895, filed Oct. 28, 2009. U.S. Appl. No. 11/399,793, filed Apr. 5, 2006.
U.S. Appl. No. 60/908,683, filed Mar. 29, 2007.
U.S. Appl. No. 12/291,108, filed Nov. 5, 2008.
U.S. Appl. No. 12/291,664, filed Nov. 10, 2008.

* cited by examiner

*Primary Examiner* — Jennifer H Gay
*Assistant Examiner* — Yong-Suk (Philip) Ro
(74) *Attorney, Agent, or Firm* — Craig R. Miles; CR Miles, P.C.

(57) ABSTRACT

Well bore fluid redistribution methods to isolate fluids produced in well bores from different geologic sections on either side of an apparatus and redistribute such fluids produced in well bores between different geologic sections to reduce surface discharge of fluids while delivering gas to a well outlet.

29 Claims, 6 Drawing Sheets

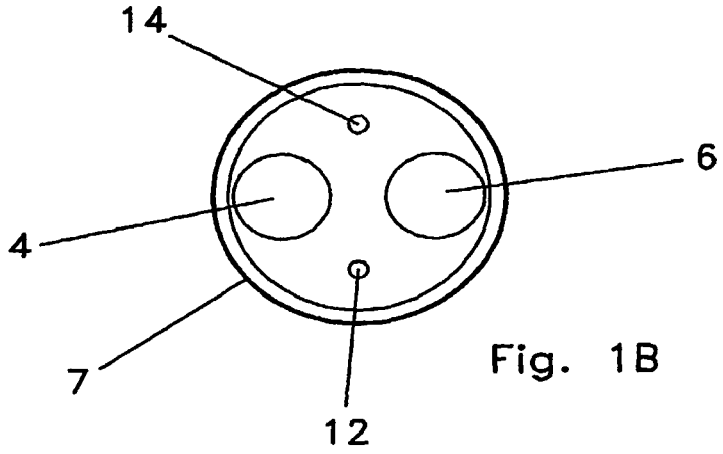
Fig. 1B
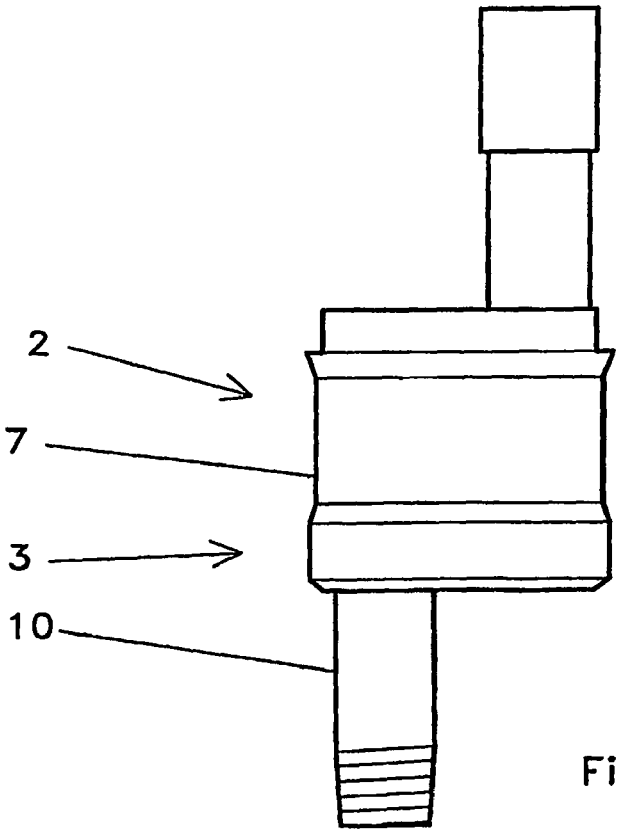
Fig. 1A
Fig. 1

Discharging Fluid Above the Depth

Discharging Fluid Below the Depth

METHOD OF REDISTRIBUTING WELL BORE FLUID

This Application is a division of U.S. patent application Ser. No. 11/910,895, filed Oct. 28, 2009, which is the National Stage of International Patent Cooperation Treaty Patent Application No. PCT/US2006/012789, filed Apr. 5, 2006, which claims the benefit of U.S. Provisional Patent Application No. 60/668,896, filed Apr. 5, 2005, each hereby incorporated by reference herein.

I. TECHNICAL FIELD

The invention relates to the redistribution of fluids produced in well bore environments. The invention in some embodiments are technologies addressing surface discharge of water produced in wells such as those producing coal bed methane and in petroleum oil and gas wells. The invention may be particularly applicable wherein costs associated with regulatory compliance are to be minimized.

II. BACKGROUND

Methane gas may be produced in the mining of coal. Coal formations naturally produce methane gas. For example, methane gas may be produced by dewatering activities of the mining process. Methane gas that is contained in the coal formation may be biogenic (generated by biologic organisms) or oragenic (generated by organic decomposition of coal) origin.

Recovery of the methane gas present in coal formations is a major source for the modern coal bed methane (CBM) industry. The recovery of such methane gas frequently involves the removal of water from the coal bed, so as, for example, to provide a reduction of pressure within the formation. The water may often be found within the coals and typically may be under pressure that increases with depth below the surface. Methane gas can be contained in the formation, for example in solution with the formation water (either free flowing or interstitially within the rock) or—adsorbing to the surface of the rock. In mining operations, it may be necessary to remove the water prior to collecting the ore. The removal of water may liberate the methane from the water or the formation by reducing the pressure under which the water is found.

In well operations, it may be necessary to pump water from the coal aquifer when the well is completed for a coal bed methane well to produce gas. Although other factors, including formation characteristics, well drilling methods, and pumping rates may play a role in production, it may be that the removal of water is possibly the most important well production factor. Traditional techniques to remove water from the well bore may include the use of a submersible pump. The pump may be placed at a depth to maximize gas flow.

The process of obtaining the maximum gas flow is often referred to as well optimization and may involve many factors. Well optimization may occur when the intake of the pump is set at a depth in the well to allow the maximum gas to be produced. If the intake is set too high in the well, water from the formation may not be sufficiently produced. In some instances, the weight of the water with reference to static water level (SWL) may prohibit the gas from desorbing from the coal and water. If the intake is set too low, water from the formation may not be sufficiently produced and the water may no longer float the coal fractures (keeping them open), possibly negatively affecting gas desorption or possibly inhibiting the flow of gas out of the coal seam. The pumping rate of the water may be used to fine tune the static water level in the well bore and may be tied to many geologic factors. Water production rates may vary from 1 gallon per minute to several hundred gallons per minute, again depending possibly on geologic conditions such as coal permeability and the thickness of the coal itself.

Produced water of coal bed methane production may be discharged to the land's surface, possibly along ephemeral drainages, tributaries and reservoirs. The quality of the produced water may vary from better than some bottled waters to poor, possibly depending on proximity of the coal bed methane well to the coal aquifer recharge area. Water qualities of coal bed methane wells in some regions typically may be better than the shallow aquifer systems that may often be used by agricultural concerns for purposes such as stock watering. However, water quality problems may occur after the water reaches the surface and travels for any distance. Surface soils may often contain salts (cations and anions) which the water may possibly dissolve as it moves along through these surface soils. At some point in the drainage, these salts may begin to accumulate, thus possibly reducing the discharged water quality. This issue may heretofore have been the subject of many studies exploring how this process may occur and the amount of time and distance over which this effect may become apparent.

The discharged water may become impaired because the discharged water may acquire salts along its path to tributaries. This impaired water may ultimately commingle with unimpaired water and may eventually degrade the fresh water supply. In an effort to monitor the amount of impaired water entering the fresh water system, governmental agencies have developed regulatory rules such as requirements for coal bed methane producers, for example permit requirements. One such permit requirement involves acquiring a National Pollution Discharge Elimination System (NPDES) permit. However, the NPDES permit acquisition process may involve significant drawbacks for coal bed methane producers, including the possibility of a substantial time and financial investment for the producer in obtaining the permit and the possibility of a denial of the permit.

In addition, environmental interests have expressed the concern that coal bed methane industry practices waste limited fresh groundwater resources. It is typically suggested that water produced by coal bed methane processes should be re-injected back into the ground. However, traditional re-injection methods may not have been economically viable to re-inject a high volume of produced water from a large number of wells. The drilling costs of each well may detract from economic viability of traditional re-injection methods. Furthermore, some formations may already contain a substantial amount of water, thus requiring large pump pressures to exceed the fracture rate of these formations in order to inject the additional waters. Traditional re-injection methods, furthermore, may be cost prohibitive given surface equipment and processes required.

Attempts may have been made to re-inject produced water into a principal drinking water aquifer where aquifer capacity may be available from a number of supply wells. However, facility and treatment costs may be prohibitively expensive.

Other traditional re-injection techniques involve drilling an additional well or wells near an existing coal bed methane well for re-injection into a shallow aquifer system, but again these attempts may not have been economically viable due to the added costs of the additional wells as well as equipment and pumping costs to re-inject the water back into the formations. Yet other attempts have involved using the produced water for irrigation, but the expenses involved in irrigation (for example, the capital outlay for an irrigation system and the treatment of soils to prevent souring) may have been so high as to be economically unsustainable. Still attempts may have involved the use of large leach-fields to dispose of water, but it may have been that relatively low permeability soils such as tight clay soils hindered the percolation process.

Other water removal attempts have been made in the context of brine water produced from conventional oil and gas reservoirs. For example, U.S. Pat. No. 3,363,692 discloses the use of a conventional beam pump or possibly pressure from the formation itself to move brine water mechanically into a shallower brine formation. However, this technique may be dependent on certain pressure ranges to work properly and may perhaps require a time cycle controller to switch a valve when water reaches a set height or time. Another patent, U.S. Pat. No. 5,816,326, discloses the use of a conventional beam pump to move brine water mechanically into a brine formation. This technique, however, appears to require the use of two mandrels to isolate perforations adjacent to a porous formation and perforated tubing to allow brine water to exit the tubing string.

The technologies of the above referenced patents and other similar technologies may also be limited in application to brine water disposal for oil and gas reservoirs and not particularly addressing the complexities of redistribution of fresh water into a fresh water system or the corresponding environment. Furthermore, the complexities associated generally with oil and gas reservoirs and traditional production equipment may actually lead those in the field away from thoughts of more efficient and less mechanically complex techniques, and particularly given the differences in the production environment.

It may be that previous attempts have been made to avoid the possible need of obtaining an NPDES permit for discharging water to the ground surface. It may also be that use of re-injection, irrigation and percolation may allow for different permitting requirements less stringent than, for example, the NPDES permit. Accordingly, a need may exist to avoid the NPDES permit system altogether, thus possibly streamlining the permit procedure and potentially reducing costs.

Water may also have a role in the secondary and tertiary recovery of oil and gas. Secondary and tertiary recovery is the recovery of oil or gas, or combinations thereof, in production-depleted reservoirs exhibiting low pressure or low flow rates, such that production is not economical or too much gas or water is present. The formation pressure, volume of product, product displacement, or fluid flow may be reduced for various reasons. In some optimal oil fields, it may sometimes be estimated that approximately 30 percent of the oil may be removed by pumping the wells (primary recovery), thus leaving perhaps 70 percent of the oil as unrecoverable. Secondary recovery, including traditional lift systems and injection methods, is typically implemented to maintain pressure and sustain production at viable rates.

Tertiary recovery or enhanced recovery alters the original oil properties and further maintains formation pressure and may be able to increase production by perhaps about 20 percent, thus potentially leaving only 50 percent of the oil recoverable. Tertiary recovery may comprise techniques such as chemical or water flooding, miscible displacement, and thermal recovery. Examples include forms such as water flood, nitrogen flood, fire flood and steam flood. Each such technique may be reservoir dependent, and often the choice of technique may be based upon economics and availability. For example, if there is no readily available source of $CO_2$ near the production facility (miscible displacement), it may be that a $CO_2$ flood may not be economically viable.

Water injection and water flooding may be common forms of secondary and tertiary recovery, perhaps due to the typical availability of large quantities of water during production. Water may be acquired perhaps by drilling a water supply well or possibly by using by-product water from existing operations. This water may typically need to be treated, perhaps by chlorination, to some standard prior to being re-injected. Injection wells may often be other existing wells, perhaps which may have diminishing production or possibly which may be optimally located for the flooding operation. However, sometimes new wells may be drilled in an area to serve solely as injection wells.

The principal in traditional water flooding may be to move the oil or other recoverable substance that may be contained within a reservoir formation to the pumping bore of a production well and to maintain formation pressure. To accomplish this technique, water may be pumped into the reservoir formation, perhaps so as to displace the trapped oil or other recoverable substance and possibly to move it towards a production well. The amount of pressure involved in driving the water within the reservoir formation may be highly variable. Such pressure may rely primarily on the transmissivity of the reservoir formation. Such pressure also may be influenced by the casing size of the well bore and the number and type of perforations made in the casing. Water flooding may typically require surface facilities such as one or more storage tanks (tank batteries), treatment facilities, pumping equipment and pipelines to be constructed. Such surface facilities may ultimately increase the operating cost of the field, perhaps reducing the economic viability of the operation.

The foregoing problems regarding conventional techniques represent a long-felt need for an effective solution. Actual attempts to meet the need to dispose or treat produced water may have been lacking in one or more aspects, for example as previously described. Those skilled in the art may not have fully appreciated the nature of the problems and challenges involved. As a result, attempts to meet these needs may not have effectively solved one or more of the problems or challenges here identified. These attempts may even have taught practices diverging from the technical directions taken in the present invention. The present invention could be considered an unexpected result of new approaches to conventional techniques that have taken by some in field.

III. DISCLOSURE OF THE INVENTION

The redistribution of fluids in well bore environments is disclosed herein in accordance with the present invention. In some embodiments, the invention is the redistribution of fluid within a well bore. The fluid may be water produced in a coal bed methane well. The redistribution of fluid, such as water, from one geologic section such as a formation to another is disclosed herein, and the redistribution from one aquifer to another aquifer is provided in accordance with the present invention. Furthermore, the injection of a geologic section with fluid, such as water produced in a coal bed methane well, and in some embodiments as a water flood of a geologic section such as a reservoir formation, in accordance with the present invention is disclosed. Some embodiments are directed to injecting fluid into at least one geologic section above a depth, while some embodiments are directed to injecting fluid into at least one geologic section below a depth. Each of the embodiments of the present invention is disclosed both as methods and processes as well as one or more apparatus and assembly.

The present invention in some embodiments is disclosed as one or more well bore fluid redistribution assembly or well bore fluid redistribution apparatus. The invention in some embodiments is methods of complying with water discharge rules. Other embodiments are water disposal, aquifer recharge, transfer of water from one aquifer to another, and obtaining a permit.

One object of the present invention may be to address and perhaps avoid discharging water produced by coal bed methane wells to the surface. Still another object of the invention may be to address compliance with water discharge rules. Another object of the invention may be to address and minimize regulatory costs associated with redistributing water produced by coal bed methane wells. Yet a further object of the invention may be to redistribute water from one geologic section to another, such as from one aquifer to another aquifer. An additional object of the invention may be to provide a water flood of a geologic section, such as a formation reservoir.

Naturally, further objects of the invention will become apparent from the description and drawings below.

IV. BRIEF DESCRIPTION OF DRAWINGS

FIG. 1 are an embodiment of a well bore fluid redistribution apparatus in accordance with the present invention; FIG. 1A is a front view of the embodiment and FIG. 1B is a cross-section of the embodiment.

V. MODE(S) FOR CARRYING OUT THE INVENTION

Figure 2:
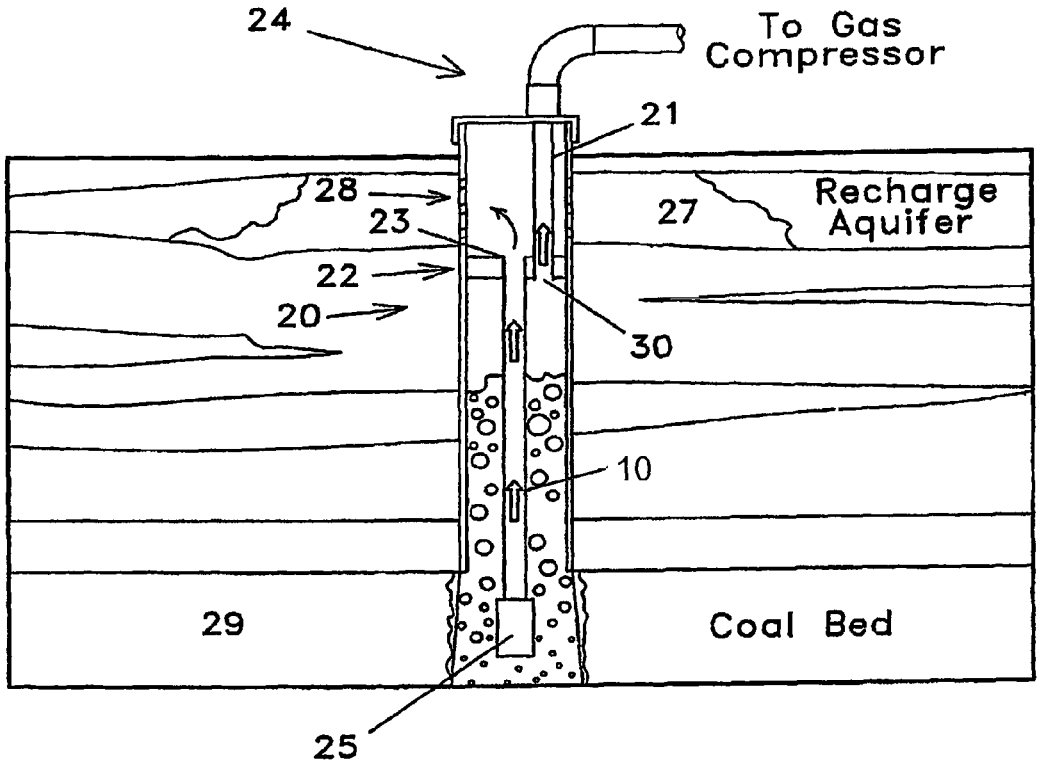
FIG. 2 is an embodiment of a well bore fluid redistribution apparatus and assembly configured in a well in accordance with the present invention.

The various disclosed features of the present invention should not be construed to limit the present invention to only certain embodiments. Furthermore, this description should be understood to support and encompass all the various embodiments of the invention, such as each method, process, device, apparatus, assembly, and business disclosed, and of each of the elements or steps of such embodiments, either alone or in combination, such as may be presented in the claims that serve as part of this disclosure.

Disclosed are one or more processes, methods, apparatus, assembly, and business that relate to concepts of redistribution of fluids in well bore environments. In certain embodiments, such techniques may allow for new functionality and even multiple functionality of a coal bed methane well. In some embodiments, such new functionality and even multiple functionality may include use of a well, such as a coal bed methane well or a petroleum oil and gas well, and as what may be referred to as a discharge well, a disposal well, an aquifer recharge well, or even what may have been traditionally named a re-injection well, or any single or combination of such well types.

Accordingly, and now in reference to FIG. 1, the invention in some embodiments is a well bore fluid redistribution apparatus 2. The apparatus 2, as further described below, provides isolation of fluid within a well bore. In some embodiments, a well bore seal element 7 is provided. The well bore seal element may function to serve as fluid isolation within a well bore. Seal element 7 may also in some embodiments simply be the body 3 of the apparatus, wherein the body 3 serves to provide isolation of fluid within a well bore. The apparatus 2 may have a port 6 configured to provide fluid communication through the apparatus 2. In some embodiments, the apparatus is configured to provide injection of fluid into at least one geologic section above the well bore seal element, and in other embodiments, configured to provide injection of fluid into at least one geologic section below the well bore seal element, as further described below and as described in FIGS. 2 and 3.

As previously mentioned, the apparatus 2 may have a body 3, which in some embodiments may be a mandrel, and body 3 may provide isolation of fluid within a well bore. In some embodiments, as described in FIG. 1, the seal element 7 may be provided with body 3, and in some embodiments, substantially encompass body 3.

A port 4 facilitates fluid communication through the apparatus. Port 4 in some embodiments is a pump port, and may be one or a plurality of ports. One or a plurality of ports 6, as described above, may be provided. Port 6 may comprise a bypass port, such as one or more gas or water ports, such as production ports to produce a fluid. One or more flow control elements may be provided to control fluid communication through port or ports 6, such as one or more valves in fluid communication with port or ports 6. Such valves may include check valves, ball or globe valves, gate valves, or similar such flow control.

In some embodiments port 6 is a coal bed methane gas port for production of gas, such as coal bed methane gas, from a coal bed methane well. The port provides communication of fluid through the apparatus and is configured to provide communication of fluid produced from the well through the redistribution apparatus. Communication through the apparatus facilitates injection of fluid into at least one geologic section above the well bore seal element, and in other embodiments, the injection of fluid into at least one geologic section below the well bore seal element, as further described below and as described in FIGS. 2 and 3.

A well bore seal element 7 is provided in some preferred embodiments of the invention. The well bore seal element isolates fluid within the well bore, and may do so as a feature of the well bore fluid redistribution apparatus in the well bore. The seal element, and the well bore fluid redistribution apparatus generally, isolate fluid communication between sections above and below the apparatus in the well bore. Correspondingly the seal element, and the well bore fluid redistribution apparatus generally, isolates fluid communication within the well bore of geologic sections above the well bore fluid redistribution apparatus and geologic sections below, as described in FIGS. 2 and 3. The well bore seal element may be removably connected with the body 3 as further described below.

The well bore seal element in some embodiments of the invention may be a packer element, and in preferred embodiments consists of one packer element, simplifying the invention in both mechanical construction and in carrying out the various embodiments of the invention. The packer element in some embodiments may comprise a sleeve or other sealing element, hi some embodiments, the packer element may be comprised of a rubber material that facilitates removal of the invention from a bore hole.

Figure 4:
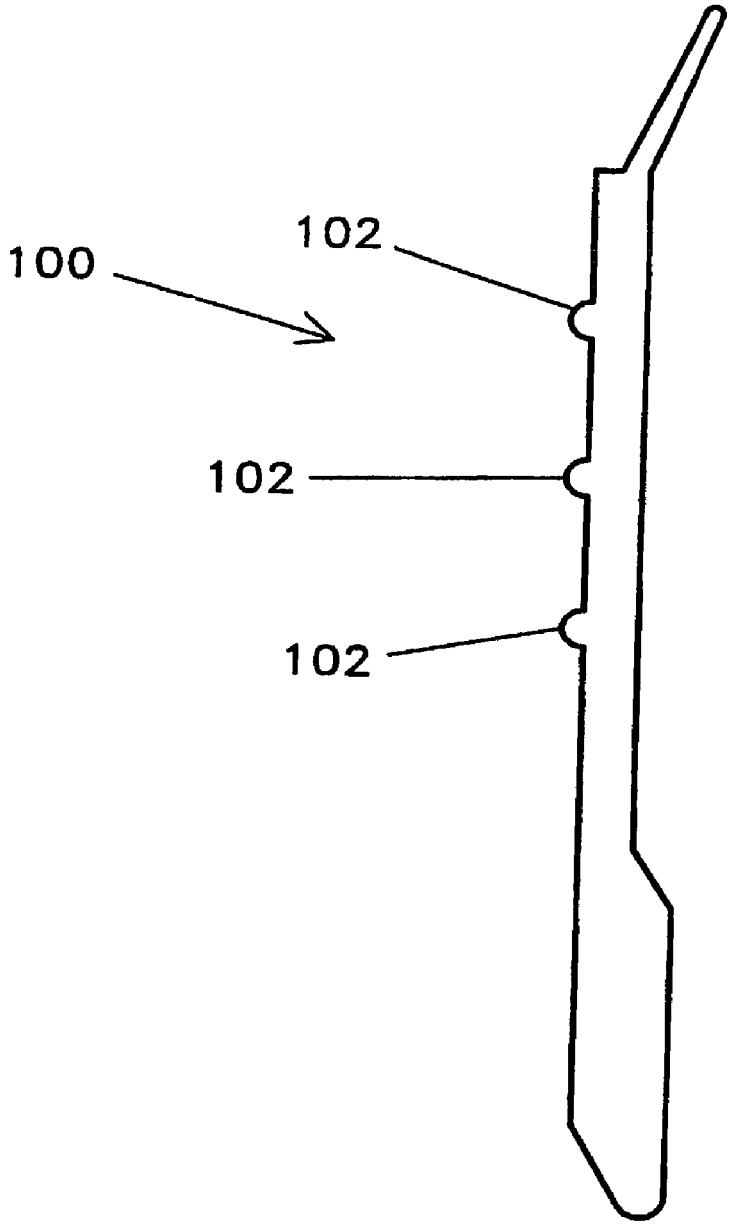
FIG. 4 is cross-section view of an embodiment of a well bore seal element in accordance with the present invention.

Now in reference to FIG. 4, one such well bore seal element comprises a packer 100. Packer 100 is described in the figure by a cross-sectional view of the packer. Packer 100 is similar in configuration with seal element 7 of FIG. 2 and in relation to apparatus 2 and body 3. The packer in some preferred embodiments is of the shape and general dimensions shown in the figure. One or more fastening elements 102 may connect the packer with body 3. In some embodiments, the fastening elements comprise a plurality of rings. FIG. 4 describes one such embodiment with three rings shown in cross-section. As described above, the invention may be pulled from a borehole in the instance when all or a portion of the invention is stuck within the borehole. In some embodiments, the body 3 may be pulled apart from packer 100.

The well bore fluid redistribution apparatus, and again with reference to FIG. 1, may have additional ports 12, 14 that may allow for power cables, sensing equipment, such as transducers, and the like to pass through the apparatus. Such additional ports may be established on the well bore fluid redistribution apparatus perhaps as power cable ports, sensor equipment ports, and the like.

FIG. 2 describes an embodiment of a well bore fluid redistribution assembly 20 and the well bore fluid redistribution apparatus, as well as methods of fluid redistribution, in accordance with the present invention. Well bore fluid redistribution apparatus 22 is configured as an element of the assembly within the well bore and isolates fluid within the well bore. A port 23 of the apparatus 22 provides fluid communication through the apparatus, preferably providing fluid communication between those sections above and below the apparatus 22 in the well bore. Pump 25 may be provided and is in fluid communication with the port 23. Pump 25 in FIG. 2 is configured in the well bore below the apparatus 22. The assembly 20 and various other embodiments of the invention may be configured according to FIG. 2. The method embodiments of fluid redistribution may also be construed in accordance with FIG. 2. Accordingly, in some embodiments, action of pump 25 redistributes fluids from below apparatus 22 to the well bore above apparatus 22. The assembly provides injection of fluid into at least a geologic section such as section 27, in some embodiments an aquifer, and potentially into a plurality of sections. The assembly of FIG. 2 is configured so that section 27 is above well bore redistribution apparatus 22. The fluid produced may be fluid from a geologic section below apparatus 22, such as a geologic section 29 that may in some applications be geologic section that has or produces coal bed methane.

Again with reference to FIG. 2, the pump 25 may have associated conduit, such as tubing 10, which may be connected with the well bore fluid redistribution apparatus 22 so as to allow fluid to be redistributed from the apparatus 22 to a second location, such as the surface, and in some embodiments through a wellhead 24. Conduit such as tubing 21 may be connected with the well bore fluid redistribution apparatus 22 so as to allow production of fluid from below the apparatus 22 to the surface. In some embodiments, the bypass port 30 of apparatus 22 may allow production fluid such as gas, and in some embodiments coal bed methane gas, to pass to the surface through tubing 22 and through the fluid and well bore between apparatus 22 and wellhead 24. Again, these features also correspondingly describe aspects of methods of fluid redistribution.

As previously mentioned, wellhead 24 may be positioned at the top of the well, and a space may exist between the well bore fluid redistribution apparatus and the wellhead. Also as previously mentioned, the combination of the fluid redistribution apparatus and other features may comprise in some embodiments a well bore fluid redistribution assembly. The apparatus thus isolates fluid communication within a well bore of at least one geologic section above the apparatus and below the well head, and provides injection of the fluid into the at least one geologic section. In some embodiments, the pump provides active production of the fluid from the geologic section below the apparatus, not simply relying upon hydrostatic pressure. The pump actively injects fluid into the at least one geologic section above the apparatus, again not simply relying upon hydrostatic pressure. Active production or active injection may be considered, in accordance with the present invention and in some embodiments, as a controlled step or feature in the production or injection process and as a controlled element.

Figure 3:
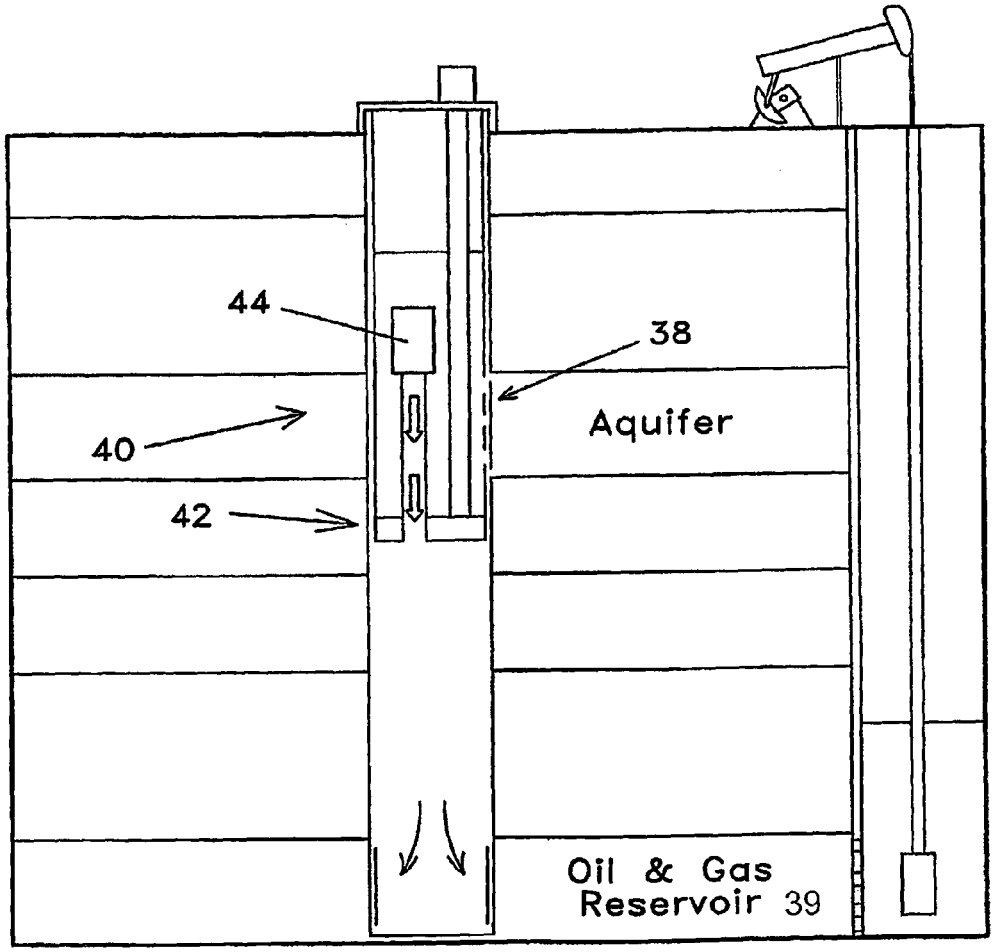
FIG. 3 is an embodiment of a well bore fluid redistribution apparatus and assembly configured in a well in accordance with the present invention.

Referencing FIGS. 1, 2 and 3, the port 23 of the well bore fluid redistribution apparatus may be configured to allow for a down hole mechanism such as a pump or pumps as shown in FIG. 2 or in FIG. 3 to be in fluid communication with port 23. The pump may be a submersible or progressive cavity pump, for example. The pump may be configured above the well bore fluid redistribution apparatus, such as configured to be suspended from the bottom of the redistribution apparatus or configured above the redistribution apparatus, as described in FIGS. 2 and 3. These features also correspondingly describe aspects of methods of fluid redistribution.

In certain embodiments no time controller may be required to use the invention, and further the invention may not be dependent on formation pressure to operate. No other mandrels may be required to isolate any geologic formation or zone such as a porous zone, and in some embodiments of the invention the wellhead and the apparatus may act to isolate the porous zone. It may also be noted that in some embodiments the well bore fluid redistribution apparatus may have no moving parts and may be able to be redressed. In some embodiments, redressing of the seal element 7 may be preferred for various inner diameter (ID) dimensions of casing.

In certain embodiments, the invention may be set in the casing of a drilled well bore at a gas separation depth, such as shown in FIG. 2 as the depth of apparatus 22 corresponding to the depth within the well bore. The gas separation depth may be the depth that allows for gas separation in the well bore at the static water level. In some applications and in some embodiments, the gas separation depth may be a depth no greater than about 500 feet. After the invention is set, water may be pumped from a location in the casing of the well bore beneath the apparatus to a location in the casing of the well bore above the apparatus, as shown in FIG. 2. Such action of the pump may create a water column in the casing above the apparatus. The column of water may be contained within the casing by the wellhead.

In some embodiments, perforations may be made in the casing of the well bore adjacent to aquifer zones, such as shown in FIG. 2 as perforations 28. Such aquifer zones may have been identified through sample collection during drilling of the well or interpreted from available well or borehole logs. Water from the water column redistributed in accordance with the invention may flow through the perforations and into the aquifer zone, perhaps by gravity or due to pressure created by the action of the pump, hi some aspects of the invention, the flow of redistributed water is controlled in accordance with the features of the invention, such as the redistribution of water and action of the pump. Moreover, the action of the pump may act to reduce the hydrostatic head of the water located below the apparatus and possibly liberate any gas contained in solution with such water, which in some embodiments may comprise methane gas. Such liberated gas may then flow through the bypass port of the apparatus. The liberated gas may then bypass the water column, perhaps through tubing 21 provided through the water column, and may be moved to the surface.

Deeper formations may contain water under pressure and therefore may not readily accept additional water unless forced under great pressure. The well bore fluid redistribution apparatus may afford the advantage of utilization of a shallow aquifer system where water may be injected with a minimal effort. Such a shallow unconfined aquifer may have available storage capacity due in part to agricultural and other development uses that may remove water as well as from drought conditions that may occur from time to time. Rather than using deep aquifers under high pressure to store water, the invention in some embodiments may use shallow unconfined aquifers that are relatively void of water.

Shallow geologic formations having permeability or porosity that may accept water can be identified from wells that have been drilled, possibly with well or borehole logs, sample cuttings or core. In some embodiments, perforations may be made adjacent to such formations from inside the well perhaps to allow communication of the formation with the bore hole. The invention may then be placed at a location below such perforations.

In some embodiments, the pump acts to drive water into a space between the apparatus and the well head. The water may be forced through the perforations within the well bore and as a result may recharge the aquifer. Gas produced by the well may be bypassed through what may be a water-filled space between the apparatus and the wellhead, perhaps by a conduit 21 from the port 30 and perhaps through the wellhead at the surface. An estimate of the amount of water to be pumped may be used for example to calculate the perforation sizes, numbers, and interval spacing needed for well optimization.

In some embodiments, the invention may allow produced water from coal bed methane activity or other well activity to be diverted into an aquifer that may possibly readily accept water and which therefore may possibly be recharged. Gas produced by the coal bed methane activity may be diverted through the water column between the apparatus and the wellhead perhaps to the surface and possibly to a gas separator or other processing systems.

The invention, in some embodiments, and with reference to the invention as disclosed throughout this disclosure, may comprise a method of redistribution of fluid within a well bore. The steps, in some embodiments in accordance with the present invention, may comprise determining a depth for isolating fluid communication within a well bore, such as previously described in an embodiment of the depth associated with apparatus 22 of FIG. 2. Further, isolating fluid communication within a well bore between at least one geologic section above the depth and below the depth, again as previously described for example in FIG. 2. Distributing a fluid by apparatus within the well bore from below the depth within the well bore to above the depth may then be accomplished, and injecting the fluid into at least one geologic section above the depth, again as described for example with reference to FIG. 2.

Further steps of redistribution comprise the invention, such as pumping the fluid through an isolation element, as may be element 7, or even apparatus 22, to above the depth. The isolation element in some embodiments may comprise apparatus 2, and in FIG. 2 element 22. Pumping the fluid through a singular isolation element to above the depth is a further possibility, wherein as described of the invention a single apparatus 2 or 22 is disclosed, such as through a packer element.

Again, as disclosed in this disclosure, and again in reference to FIG. 2, steps may include injecting the fluid into at least one aquifer; the step may even comprise recharging at least one aquifer by way of such redistribution. The other one or more steps, alone or in combination, and as previously described in with reference for example to FIG. 2, may be to produce a fluid from at least one geologic section below the determined depth; producing the fluid from at least one geologic section comprising coal bed methane; producing a coal bed methane gas; producing coal bed methane gas to the well head; producing the coal bed methane gas to production facilities; bypassing the coal bed methane gas beyond the determined depth; and isolating fluid communication within a well bore between at least one geologic section above the depth and below the depth so as to isolate fluid communication between the depth and a well head.

Again with reference to FIG. 2, further steps of the invention may be to inject the fluid into at least one geologic section between the depth and the well head. Also isolating fluid communication between the depth and a well head and injecting the fluid into at least one geologic section between the depth and the well head, as previously described. Also, steps of distributing may be pumping the fluid with a pump within the well bore, or distributing the fluid into the well bore above the referenced depth. As previously mentioned, the pump may be used to actively distribute the fluid, such as actively distributing the fluid above the depth. Also a previously mentioned, further steps of the invention may comprise actively producing the fluid below the depth, as with reference to the pump or other elements, or actively injecting the fluid above the depth.

The invention may further comprise reducing the hydrostatic head of fluid below the depth, so as, for example, to facilitate gas production, and even facilitating the production of coal bed methane gas. Again, coal bed methane gas may be produced as may be shown and described in FIG. 2. Injecting may comprise disposing of the fluid, while additional steps of enhancing water quality of water in the at least one geologic section above the depth may be accomplished with, for example, higher water quality of produced water. The water from the lower geologic section may be of higher water quality. Also, in like fashion given the injection process, the at least one aquifer above the depth may be recharged. Additionally, steps of disposal and compliance may be accomplished in accordance with the invention, wherein obviating a need for water disposal permitting, obviating a need for surface water disposal, and reducing regulatory compliance corresponding to surface water disposal are disclosed, as previously discussed and as further disclosed below.

In certain embodiments, it may not be necessary to acquire a NPDES permit. This may be in part due to the inventive nature of the invention such that no fluids may be discharged to the surface. It may even be the case that any permits that may be required involve a significantly reduced regulatory compliance burden as compared to a NPDES permit. It may also be the result of the present invention that water of sufficient high quality is disposed in accordance with quality standards.

In certain embodiments, the present invention may allow for aquifer recharge, or the placement of water into aquifers, and may not be limited to disposal well applications. It may also be that the water quality of produced water may be relatively better than in a shallow aquifer and may not only recharge such shallow aquifers but may do so with higher quality water. However, in some embodiments the present invention may also be able to dispose of water in brine water aquifers as well.

Figure 5:
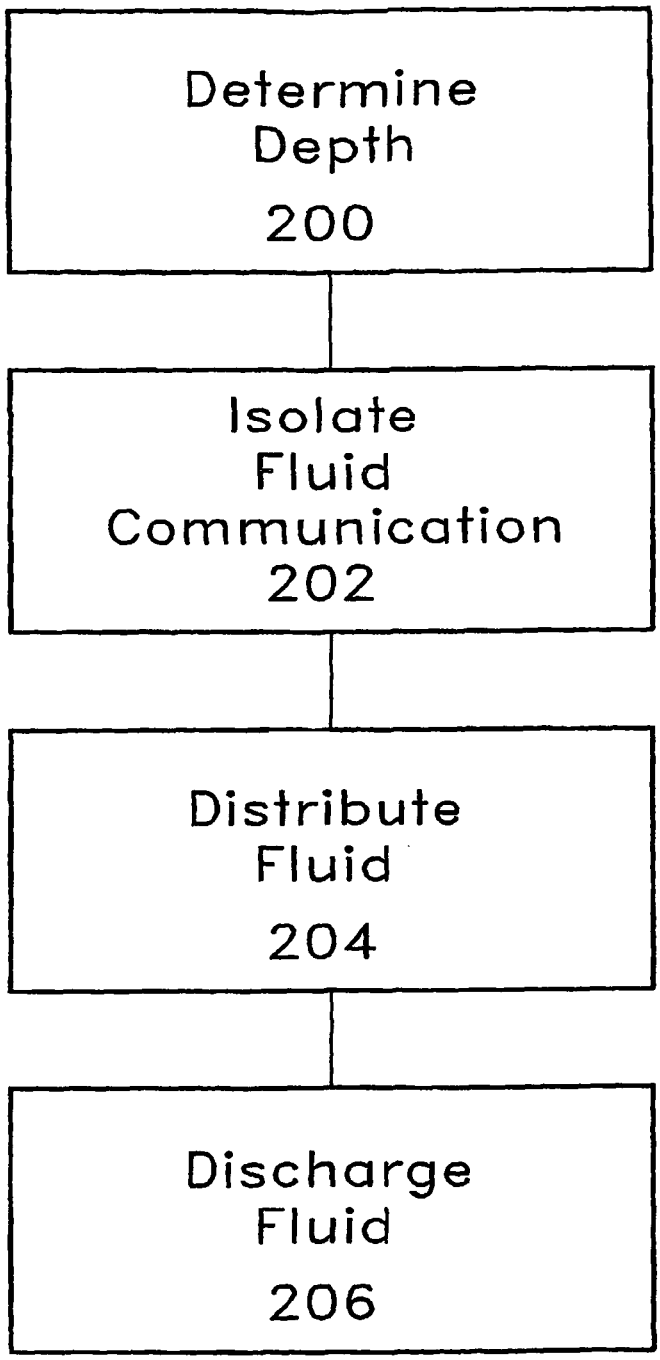
FIG. 5 is a flow diagram of one embodiment of a method in accordance with the present invention.

Accordingly, a method of compliance with water discharge rules is disclosed. FIG. 5 describes one process. The invention in some embodiments may provide step 200 the determination of a depth for isolating fluid communication within a well bore, 202 isolate fluid communication within a well bore between at least one geologic section above the depth and below the depth, such as in embodiments previously described. Further, the step 204 of distributing a fluid by apparatus within the well bore from below the depth within the well bore to above the depth may be performed and further step 206 of discharging the fluid into at least one geologic section above the depth. A step of producing coal bed methane gas can be performed as previously described and other steps may include the step of injecting performed as disposing of the fluid. Other steps may be to enhance water quality of water in the at least one geologic section above the depth, such as by the redistribution of high quality water, or the step of recharging at least one aquifer above the depth. The invention allows for compliance that obviates a need for water disposal permitting, perhaps under traditional disposal permitting. The invention obviates a need for surface water disposal through redistribution, and reduces regulatory compliance corresponding to surface water disposal.

The present invention may also have beneficial application in the secondary and tertiary recovery of oil and gas. Each of the previously disclosed elements and steps of the present invention will correspond to and are disclosed and incorporated by reference in the embodiments disclosed for the following applications. Accordingly, in some embodiments of the present invention, and with reference to the configuration of FIG. 3, the well bore fluid redistribution assembly 40 and well bore fluid redistribution apparatus 42 may be placed within either a new or existing well, perhaps an injection well, and perhaps just above the perforations 38. A pump such as pump 44 may be installed above the apparatus 42 and inverted, and in some embodiments, providing that when the pump is activated it may drive fluid downward and out through the port such as the pump port of apparatus 42. Perforations 38 may possibly be made in a shallower aquifer system, perhaps located above the apparatus 42, so as to allow water to enter the well bore between the apparatus 42 and the wellhead. When the pump is activated, the water may be driven down through the apparatus 22, and into a desired geologic formation, such as a reservoir formation, and providing in some embodiments a water flood. No costly surface equipment may be needed, and treatment of the water may not be needed. As a result, the cost of conducting the water flood may be significantly reduced as compared to conventional techniques requiring surface facilities.

Accordingly, a well bore fluid redistribution assembly in accordance with the present invention may comprise a well bore fluid redistribution apparatus providing isolation of fluid within a well bore; a port configured to provide fluid communication through the apparatus; and a pump in fluid communication with the port and configured above the apparatus in a well bore; wherein the assembly is configured to provide injection of fluid into at least one geologic section below the apparatus.

In accordance with the invention, and in reference to FIG. 3, the apparatus isolates fluid communication within a well bore between at least one geologic section above the apparatus and at least one geologic section below the apparatus. The assembly is configured in some embodiments to provide injection of fluid produced from at least one geologic section comprising coal bed methane, or injection of fluid into at least one aquifer below the apparatus. The assembly is configured to provide injection of fluid produced above the apparatus as shown, and the apparatus may comprise a well bore seal element as previously disclosed with reference to FIGS. 1 and 2. The invention, again as previously disclosed, may comprise a body and the well bore seal element comprises a plurality of attachment elements. The body is connected, possibly removably connected, with the well bore seal element by the plurality of attachment elements, as previously disclosed.

The ports of the invention in reference to FIG. 3 may comprise a second port configured to provide fluid communication through the apparatus, such as a bypass port, or a port configured to provide communication of fluid produced below the apparatus. The port may be configured to provide communication of coal bed methane produced below said apparatus. At least a third port may be provided, as again may be seen in FIG. 1. The apparatus 42 isolates fluid communication within a well bore of at least one geologic section below the apparatus and above a well bottom, similar to the embodiments previously described. The assembly 40 is configured to provide injection of fluid into the at least one geologic section below the apparatus.

The pump 44 actively produces fluid from a geologic section above the apparatus and actively injects the fluid into said at least one geologic section below said apparatus, similar to the embodiments previously described, and may actively injects fluid into at least one reservoir formation, potentially as a water flood, and also may actively reduce hydrostatic head of fluid within the well bore and above the apparatus.

The apparatus 42, in some embodiments, may comprise a well bore fluid redistribution apparatus, comprising a well bore seal element providing isolation of fluid within a well bore; and a port configured to provide fluid communication through the apparatus; wherein the apparatus is configured to provide injection of fluid into at least one geologic section below the well bore seal element. The various elements of the invention are described above with reference to FIG. 3 and also in reference to FIGS. 1 and 2 as applied.

Furthermore, a method of redistribution of fluid within a well bore is disclosed, and in reference to FIG. 3, comprise the steps of determining a depth for isolating fluid communication within a well bore; isolating fluid communication within a well bore between at least one geologic section above the depth and below the depth; distributing a fluid by apparatus within the well bore from above the depth within the well bore to below the depth; and injecting the fluid into at least one geologic section below the depth.

Additional steps, alone or in combination, in reference to FIG. 3 and as previously described, comprise pumping the fluid through an isolation element to below the depth; pumping the fluid through a singular isolation element to below the depth, such as apparatus 42; and injecting said fluid into at least one aquifer. Again, injecting may comprise injecting the fluid into at least one reservoir formation, such as by water flooding. Again, producing a fluid from at least one geologic section above the depth is shown in FIG. 3, and producing from at least one geologic section comprising coal bed methane, and even producing a coal bed methane gas, such as to the well head, and in some embodiments, to production facilities.

Isolating fluid communication within a well bore between at least one geologic section below the depth and above the depth, as described in FIG. 3, may comprise isolating fluid communication between the depth and a well bottom, so that injecting comprises injecting the fluid into at least one geologic section between the depth and the well bottom, wherein the well is so configured.

Distributing steps in accordance with the present invention may comprise pumping the fluid with a pump within the well bore; distributing the fluid into the well bore below the depth; actively distributing the fluid, such as described above, or even actively distributing the fluid below the depth, and even actively producing the fluid above the depth. Active pumping or redistributing may further comprise actively injecting the fluid below depth. Active again refers to activity controlled and not simply by hydrostatic means.

Other features may comprise the step of reducing the hydrostatic head of fluid above the depth. The step of reducing the hydrostatic head may comprise facilitating the production of coal bed methane gas. Producing coal bed methane gas, or even oil or petroleum gas, can be performed in FIG. 3 as disclosed for production of gas above. Injecting may comprise the step of disposing of the fluid or enhancing water quality of water in the at least one geologic section below the depth, as previously described and as shown in FIG. 3. Also, recharging at least one aquifer below the depth, obviating a need for water disposal permitting, obviating a need for surface water disposal, and reducing regulatory compliance corresponding to surface water disposal are disclosed, as previously described and as described below.

Figure 6:
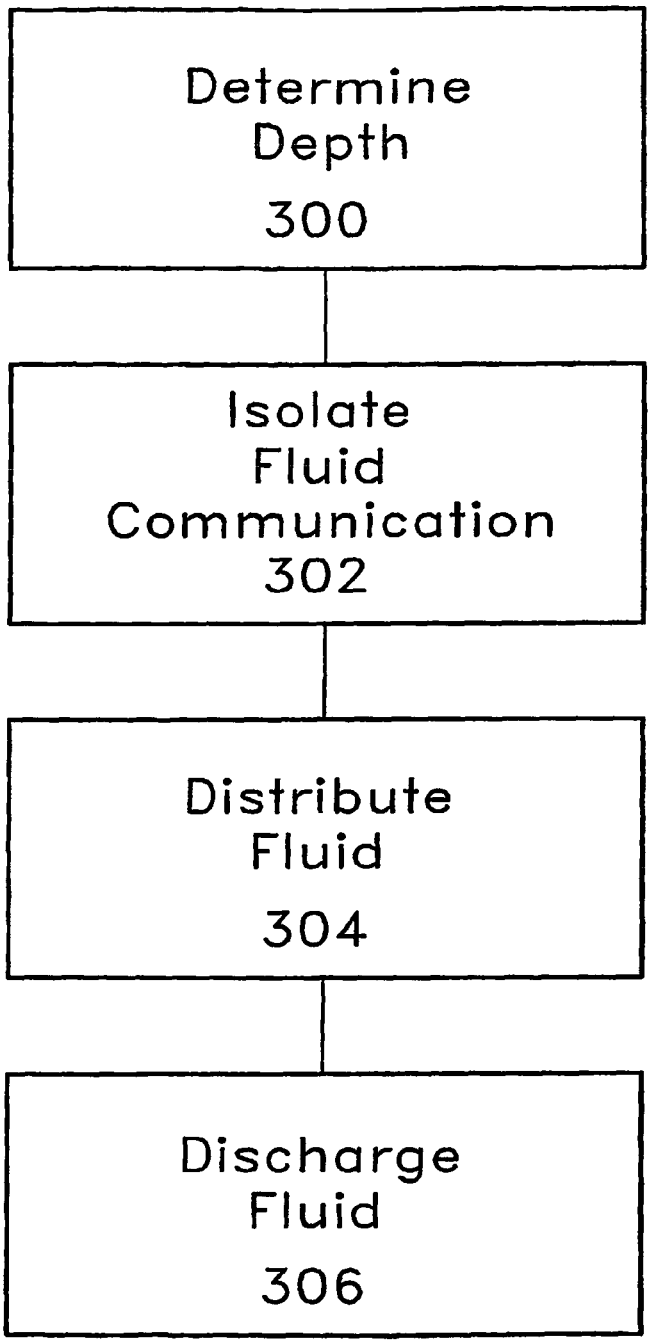
FIG. 6 is a flow diagram of one embodiment of a method in accordance with the present invention.

Additionally, and as previously discussed in other embodiments, the invention may comprise a method of compliance with water discharge rules. As shown and may be seen in FIG. 3, and as previously described, the steps may comprise determining a depth for isolating fluid communication within a well bore; isolating fluid communication within a well bore between at least one geologic section above the depth and below the depth; distributing a fluid by apparatus within the well bore from above the depth within the well bore to below the depth; and discharging the fluid into at least one geologic section below the depth. One such process is shown and described in FIG. 6. The embodiments are consistent with those inventions described with respect to FIG. 3. Furthermore, the embodiments are disclosed also with reference to those embodiments described with respect to FIG. 5, with at least some differences in distribution and discharging aspects as are readily seen throughout this disclosure.

Methods for compliance may further comprise steps of producing coal bed methane gas; producing oil; and producing petroleum gas, as previously described for example in reference to FIG. 3. Injecting may comprises the step of disposing of the fluid, and even enhancing water quality of water in the at least one geologic section below the depth. Recharging at least one aquifer below the depth may be accomplished in accordance with the invention, such as shown in FIG. 3. The redistribution of the fluid may again obviate a need for water disposal permitting, obviate a need for surface water disposal, and reduce regulatory compliance corresponding to surface water disposal.

In other embodiments of the invention, each of the features may be performed to accomplish traditional production activities, such as water disposal, aquifer recharge, transfer of water from one aquifer to another, and obtaining a permit regarding the distribution of water, either primarily or as a component of the operation to be considered. For example, one embodiment of the invention achieving either water disposal, aquifer recharge, transfer of water from one aquifer to another, and obtaining a permit regarding the distribution of water may be performed by determining a depth for isolating fluid communication within a well bore; isolating fluid communication within a well bore between at least one geologic section above the depth and below the depth; distributing a fluid by apparatus within the well bore corresponding to the depth; and discharging the fluid into at least one geologic section. Furthermore, steps of reporting may be reporting results obtained from the performance of the steps or reporting the steps prior to performance of the steps, such as in the approval of a production activity.

As can be easily understood from the foregoing, the basic concepts of the present invention may be embodied in a variety of ways. It involves both redistribution techniques as well as devices to accomplish the redistribution. In this application, the distribution, redistribution, injecting, compliance, and other techniques of the present invention are disclosed as part of the results shown to be achieved by and the function of the various devices described and even as steps that are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these embodiments are encompassed by this disclosure.

Each feature, step, or element of the present invention can be representative of a broader function or of a great variety of alternative or equivalent features, steps, or elements. Each such broad function, alternative, or equivalent are included in this disclosure. Where the invention is described in device-oriented terminology, each element of the device implicitly performs a function; and if the invention is described as a function, each step of the method or process implicitly corresponds to an element, device, apparatus or assembly.

Any reference listed to be incorporated by reference in this application is hereby appended and hereby incorporated by reference; however, as to each of the above, to the extent that such information or statements incorporated by reference might be considered inconsistent with the patenting of the present invention, such as contradicting defined features or features ascertained by a reading of these patent documents, such information and statements are expressly not to be considered incorporated by reference. Furthermore, as to any dictionary definition or other extrinsic evidence utilized to construe this disclosure, if more than one definition is consistent with the use of the words in the intrinsic record, the claim terms should be construed to encompass all such consistent meanings.

Disclosure should be understood to exist to the degree required under new matter laws—including but not limited to European Patent Convention Article 123(2) and United States Patent Law 35 USC 132 or other such laws~to permit the addition of any of the various dependencies or other elements presented under one independent claim or concept as dependencies or elements under any other independent claim or concept.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

We claim:

1. A method of redistribution of fluid within a well bore, comprising:

determining a depth for isolating fluid communication within a well bore;

isolating fluid communication within a well bore between at least one geologic section above said depth and below said depth;

pumping an amount of liquid by an apparatus within said well bore from below said depth within the well bore to above said depth;

injecting said amount of liquid into at least one geologic section above said depth; and bypassing said at least one geologic section above said depth to permit an amount of gas in said well bore below said depth to rise to the surface of said well bore, wherein bypassing includes a bypassing conduit without a pump extending to the surface of said well bore.

2. The method of redistribution of fluid within a well bore as described in claim 1, further comprising pumping said fluid through an isolation element to above said depth.

3. The method of redistribution of fluid within a well bore as described in claim 1, further comprising pumping said fluid through a singular isolation element to above said depth.

4. The method of redistribution of fluid within a well bore as described in claim 3, wherein pumping said fluid through a singular isolation element comprises pumping through a packer element.

5. The method of redistribution of fluid within a well bore as described in claim 1, wherein injecting comprises injecting said fluid into at least one aquifer.

6. The method of redistribution of fluid within a well bore as described in claim 1, wherein injecting comprises recharging at least one aquifer.

7. The method of redistribution of fluid within a well bore as described in claim 1, further comprising producing a fluid from at least one geologic section below said depth.

8. The method of redistribution of fluid within a well bore as described in claim 7, wherein producing comprises producing said fluid from at least one geologic section comprising coal bed methane.

9. The method of redistribution of fluid within a well bore as described in claim 7, wherein producing comprises producing a coal bed methane gas.

10. The method of redistribution of fluid within a well bore as described in claim 9, wherein producing said coal bed methane gas comprises producing said coal bed methane gas to the well head.

11. The method of redistribution of fluid within a well bore as described in claim 9, wherein producing said coal bed methane gas comprises producing said coal bed methane gas to the production facilities.

12. The method of redistribution of fluid within a well bore as described in claim 1, wherein isolating fluid communication within a well bore between at least one geologic section above said depth and below said depth comprises isolating fluid communication between said depth and well head.

13. The method of redistribution of fluid within a well bore as described in claim 12, wherein injecting comprises injecting said fluid into at least one geologic section between said depth and said well head.

14. The method of redistribution of fluid within a well bore as described in claim 1, further comprising isolating fluid communication between said depth and a well head and injecting said fluid into at least one geologic section between said depth and said well head.

15. The method of redistribution of fluid within a well bore as described in claim 1, wherein distributing comprises pumping said fluid with a pump within the well bore.

16. The method of redistribution of fluid within a well bore as described in claim 1, wherein distributing comprises distributing said fluid into the well bore above said depth.

17. The method of redistribution of fluid within a well bore as described in claim 1, wherein distributing comprises actively distributing said fluid.

18. The method of redistribution of fluid within a well bore as described in claim 17, wherein actively distributing comprises actively distributing said fluid above said depth.

19. The method of redistribution of fluid within a well bore as described in claim 1, further comprising actively producing said fluid below said depth.

20. The method of redistribution of fluid within a well bore as described in claim 1, further comprising actively injecting said fluid above said depth.

21. The method of redistribution of fluid within a well bore as described in claim 1, further comprising reducing the hydrostatic head of fluid below said depth.

22. The method of redistribution of fluid within a well bore as described in claim 1, wherein reducing the hydrostatic head comprises facilitating the production of coal bed methane gas.

23. The method of redistribution of fluid within a well bore as described in claim 1, further comprising producing coal bed methane gas.

24. The method of redistribution of fluid within a well bore as described in claim 1, wherein injecting comprises the step of disposing of said fluid.

25. The method of redistribution of fluid within a well bore as described in claim 1, further comprising enhancing water quality of water in said at least one geologic section above said depth.

26. The method of redistribution of fluid within a well bore as described in claim 1, further comprising recharging at least one aquifer above said depth.

27. The method of redistribution of fluid within a well bore as described in claim 1, further comprising obviating a need for water disposal permitting.

28. The method of redistribution of fluid within a well bore as described in claim 1, further comprising obviating a need for surface water disposal.

29. The method of redistribution of fluid within a well bore as described in claim 1, further comprising reducing regulatory compliance corresponding to surface water disposal.

* * * * *